US012523038B2

(12) United States Patent
Schaap et al.

(10) Patent No.: US 12,523,038 B2
(45) Date of Patent: Jan. 13, 2026

(54) BUILDING ELEMENT, A METHOD FOR THE MANUFACTURE THEREOF, A PROFILE AND A COMBINATION OF A PROFILE AND A PANEL

(71) Applicant: Denta Engineering B.V., Soest (NL)

(72) Inventors: Foeke Jasper Schaap, Soest (NL); Jacobus Cornelis Buschgens, Soest (NL)

( * ) Notice: Subject to any disclaimer, the term of this patent is extended or adjusted under 35 U.S.C. 154(b) by 282 days.

(21) Appl. No.: 18/143,453

(22) Filed: May 4, 2023

(65) Prior Publication Data

US 2023/0358042 A1 Nov. 9, 2023

(51) Int. Cl.
*E04C 2/32* (2006.01)
*E04C 2/26* (2006.01)

(52) U.S. Cl.
CPC . *E04C 2/32* (2013.01); *E04C 2/26* (2013.01)

(58) Field of Classification Search
CPC ..... E04C 2/32; E04C 2/26
USPC ..... 52/578
See application file for complete search history.

(56) References Cited

U.S. PATENT DOCUMENTS 3,348,459 A * 10/1967 Harvey ..... E01C 9/083 404/35
4,084,367 A * 4/1978 Saylor ..... B29D 24/005 428/116
5,339,577 A * 8/1994 Snyder ..... E04B 9/0414 52/783.17
5,411,782 A * 5/1995 Jarvis ..... E04H 4/08 428/188
5,706,620 A * 1/1998 De Zen ..... H02G 3/286 52/270
5,729,944 A * 3/1998 De Zen ..... E04B 2/8629 52/439
6,079,175 A * 6/2000 Clear ..... E04C 2/36 52/439
7,127,865 B2 * 10/2006 Douglas ..... E04C 2/20 52/270
8,453,793 B1 * 6/2013 Franzoi ..... F02C 7/045 181/290
9,850,658 B2 * 12/2017 Alcala Ordaz ..... E04B 2/8658
11,541,440 B2 * 1/2023 Beland ..... E04C 3/06
12,000,136 B2 * 6/2024 Wang ..... E04B 1/34321
(Continued)

FOREIGN PATENT DOCUMENTS

GB 2481143 12/2011
GB 2481143 A * 12/2011 ..... A47B 96/205
(Continued)

*Primary Examiner* — Paola Agudelo
(74) *Attorney, Agent, or Firm* — Wilcox & Myers, P.C.; Jeffrey D. Myers

(57) ABSTRACT

A building element, comprising a profile and a panel, characterized in that the profile and the panel are mutually coupled by means of a deformation of the panel inside the profile. The profile preferably comprises a housing with an inner wall and an internal space defined within the inner wall and at least one access opening in the inner wall providing access to the inner space, wherein in the inner space at least a part of a form element is arranged, which form element is coupled to the inner wall on a side remote from the access opening, and wherein a thickness of the form element near the coupling to the inner wall is smaller than at a position between the coupling to the inner wall and the access opening.

19 Claims, 2 Drawing Sheets

(56) References Cited

U.S. PATENT DOCUMENTS

| | | | | |
|---|---|---|---|---|
| 2006/0230700 | A1* | 10/2006 | Chen | E04C 2/20 52/586.1 |
| 2007/0256379 | A1* | 11/2007 | Edwards | B32B 21/047 52/309.9 |
| 2012/0266553 | A1* | 10/2012 | Shiao | E04D 3/357 428/116 |
| 2013/0025220 | A1* | 1/2013 | Yu | E04C 2/521 52/243 |
| 2018/0311926 | A1* | 11/2018 | Tyan | B31D 3/0284 |
| 2022/0396005 | A1* | 12/2022 | Lindemann | E04C 5/162 |
| 2024/0139996 | A1* | 5/2024 | Mayer | E04G 21/0463 |

FOREIGN PATENT DOCUMENTS

| | | | |
|---|---|---|---|
| WO | 200150068 | A1 | 7/2001 |
| WO | 2017149342 | A1 | 9/2017 |

* cited by examiner

BUILDING ELEMENT, A METHOD FOR THE MANUFACTURE THEREOF, A PROFILE AND A COMBINATION OF A PROFILE AND A PANEL

The present invention relates to a building element according to the preamble of claim 1. The invention also relates to a method for its manufacture, to a combination of a profile and a panel and to the profile separately.

Such a building element is known in the art. For example, it is known to provide panels with a profile running on the circumferential edge which are coupled with destructive connecting means such as screws, rivets, glue, putty or the like. The profiles are used to connect the building elements to each other or to other objects. Furthermore, putty or the like is used to seal seams to obtain water tightness of the structure.

Such a construction element has the drawback that the coupling to the panel takes a lot of time and requires an accurate treatment in order to obtain a stable and secure coupling. These drawbacks make the known building elements expensive and lead to structural damage to the panels and the profiles due to the screws or the like used.

There is a need in the art for an improved building element.

The object of the invention is now to provide an improved building element of the type mentioned in the preamble.

In particular, the object of the invention is to provide a building element of the type mentioned in the preamble, which makes possible a simple coupling between profile and panel.

It is also an object of the invention to provide an improved building element which can be obtained quickly and with great certainty from a profile and a panel.

In order to obtain at least one of the above-mentioned advantages, according to a first embodiment, the invention provides a building element which comprises the features of claim 1. This building element has the advantage that the coupling can be obtained very quickly.

The invention also offers the advantage that the building element according to the invention can be formed in a fully automated manner. In addition, a certain coupling is provided. Due to the fusion of profile and panel, a mutual connection is obtained which is not releasable under conditions of use. Such a synergistic action is a particularly great advantage.

A further advantage of the present invention is its complete recyclability. The materials used can be easily separated from each other after use, so that reuse is possible.

By using thermoplastic synthetic material, a building element with a low weight is obtained, but which provides an exceptionally high stiffness and strength. This has a great advantage in, for example, the transport sector, whereby the loading capacity of a wagon or trailer is increased in accordance with the weight saving compared to conventional vehicles.

The invention therefore relates to a building element, comprising a profile and a panel, characterized in that the profile and the panel are mutually coupled by means of a deformation of the panel inside the profile. The deformation can take place in various ways. For example, a thermoplastic material can be used in the panel, which can be deformed at a temperature used during coupling, which is increased relative to a temperature of use, so that it adapts to an internal shape present in the profile, which prevents the panel material from being removed from the profile when cooled to operating temperature. It is also possible to use a material in the panel which deforms by applying force, for instance a metal which has a lower yield point or deformation limit than the material of the profile.

Within the invention, thermoplastic material is understood to mean a material that is hard at a temperature of use, i.e. at application or operation thereof, and which can be deformed at an elevated temperature, which is higher than the temperature of use, so that the material can assume a different shape which, after cooling to a temperature of use, has a dimensional stability that prevents the panel from being removed from the profile without damage.

Preferably, the profile comprises a housing with an inner wall and an inner space defined within the inner wall and at least one access opening in the inner wall which provides access to the inner space, wherein at least a part of a form element is arranged in the inner space, which form element is coupled to the inner wall on a side remote from the access opening and wherein a thickness of the form element near the coupling to the inner wall is smaller than at a position between the coupling to the inner wall and the access opening. As a result, the panel will partly settle in the space between the form element and the inner wall during the deformation. Since the deformation is obtained in the deformable state at a temperature suitable therefor, the connection will be inseparably connected to the profile after cooling to temperature of use.

A further preference is given to a building element in which the panel in undeformed condition comprises two main surfaces situated opposite each other, wherein the main surfaces each comprise a plate-shaped element of a material deformable upon heating and a deformable core material is provided between the two plate-shaped elements. This makes it possible in a simple manner to obtain an accommodation of the plastic sheet material in the space between the form element and the inner wall of the profile. The deformable core material may be a material which is readily mechanically deformable upon application of a suitable force or may also be a thermoplastic material. Preferably, it has the same melting or ductility properties as the thermoplastic sheet material.

An alternative embodiment provides that one or more other plate-shaped elements are provided between the two opposite plate-shaped elements, wherein preferably all plate-shaped elements are separated from each other by a deformable core material. The core material can be identical in all cases, but optionally different kinds of core material can be used at different positions between plate-shaped elements.

It is particularly preferred that the plate-shaped elements also comprise a fiber filling or fiber reinforcement. The fibers provide a further improved shape retention and strength of the coupling of the panel inside the profile.

A width of the access opening of the profile is preferably substantially equal to a distance between the two main surfaces of the panel in undeformed condition. As a result, the panel fits accurately in the profile, so that an optimal coupling can be obtained.

The aforementioned core material particularly preferably comprises a non-solid material, for example with a honeycomb structure or a foam structure with closed or open pores. As a result, when the panel and the profile are joined together, the core material can be compressed against the form element, while the panels between the form element and the inner wall are carried to the space between the rear wall of the profile facing away from the access opening and nestle there.

Although the form element may have a rounded shape in order to obtain a uniform displacement of the plate-shaped elements around the form element, it is preferred that the form element comprises a shoulder surface directed away from the access opening. As a result, a reinforced confinement of the thermoplastic material behind the molding element is obtained.

The profile of the building element according to the invention preferably comprises in the internal space an inner wall which extends arcuately from the access opening to the coupling of the core material with the outer wall. This ensures an even displacement of the thermoplastic plate-shaped element along the inner wall, so that a precisely defined deformation can be obtained.

As mentioned, it is preferred that in the building element according to the invention the plate-shaped elements comprise a thermoplastic material.

The profile of the building element according to the invention preferably comprises at least one material selected from a group comprising a metal, a thermosetting material and a material with a resistance to deformation up to at least 170° C., preferably at least 200° C., more preferably at least 250° C., even more preferably at least 400° C., for example at least 650° C. Such a material offers sufficient dimensional stability when joining the panel and the profile if a thermoplastic is used as the material of the plate-shaped elements.

The invention also relates to a combination for manufacturing a building element according to the invention, comprising a profile and a panel, wherein the profile comprises a housing with an inner wall and an internal space defined within the inner wall and an access opening in the inner wall which provides access to the internal space, wherein a form element is arranged in the internal space, which form element is coupled to the inner wall on a side remote from the access opening and wherein a thickness of the form element near the coupling with the inner wall is smaller than at a position between the coupling with the inner wall and the access opening. This combination can be used for the simple manufacture of a building element according to the invention.

To this end, the invention also relates to a method for manufacturing a building element according to the invention and as described in detail above, comprising the steps of joining the profile and the panel by feeding the panel into the access opening while deforming at least one part of the panel within the profile.

In particular, the invention relates to a method comprising the step of deforming the deformable core material.

The invention also relates to a method comprising deforming the two plate-shaped elements around the molding element.

The invention also includes a method comprising heating at least a part of the profile to a temperature at which at least a part of the panel is in a plastically deformable condition and wherein the profile is in a non-plastically deformable condition, at preferably a temperature between 150° C. and 650° C.

In addition, the invention relates to a profile for use in the building element according to the invention and as described above, as well as for use in the combination according to the invention and as described above or in the method according to the invention and as described above, comprising a housing with an inner wall and an inner space and an access opening which provides access to the inner space, wherein a form element is arranged in the inner space, which form element is coupled to the inner wall on a side remote from the access opening and wherein a thickness of the form element near the coupling with the inner wall is smaller than at a position between the coupling with the inner wall and the access opening.

According to an alternative embodiment, the profile comprises a central material part with an internal space on different sides, each with a shape element and an access opening. This allows two panels to be coupled to a single profile, which provides increased rigidity when larger distances have to be spanned, and also provides the advantage that a direct connection of several panels is possible without the use of coupling means such as screws or other means for which a destruction of one of the materials is required.

The invention will be explained in more detail below with reference to drawings. The drawings hereby show:

FIG. 1 is a side sectional view of a first profile according to the invention, FIG. 2 is a side sectional view of a second profile according to the invention, FIG. 3 is a side sectional view of a third profile according to the invention, FIG. 4 is a side sectional view of a fourth profile according to the invention, FIG. 5 is a sectional side view of a fifth profile according to the invention, FIG. 6 is a sectional side view of a sixth profile according to the invention, FIG. 7 is a sectional side view of a seventh profile according to the invention, FIG. 8 is a side sectional view of an eighth profile according to the invention, FIG. 9 is a perspective view of a profile according to FIG. 4, FIG. 10 is a perspective view of a panel according to the invention, and FIG. 11 is a cross-sectional side view of a coupled panel and a profile according to the invention.

In the figures, the same parts are indicated by the same reference numerals. However, the parts necessary for a practical implementation of the invention are not all shown, because of the simplicity of the representation.

FIGS. 1 to 4 and 6 to 8 show various shapes of profiles 1 according to the invention. The profiles 1 each comprise a housing 2 with an inner wall 3 and a form element in the interior space 4 defined by the inner wall. An access opening 5 provides access from the environment 6 to the interior space 4. The form element has in each of the FIGS. 1, 2, 3 and 4 a different shape. In FIGS. 1, 2 and 4, a neck 7 is provided between the form element 8, 9, 10 and the rear wall 12, while in FIG. 3, the form element 11 is formed directly on the rear wall 12.

In FIG. 4, deviating from FIGS. 1, 2 and 3, an arc-shaped design of the inner wall 3 is used.

Figures 1, 2, 3, 4, 5, 6, 7, 8:
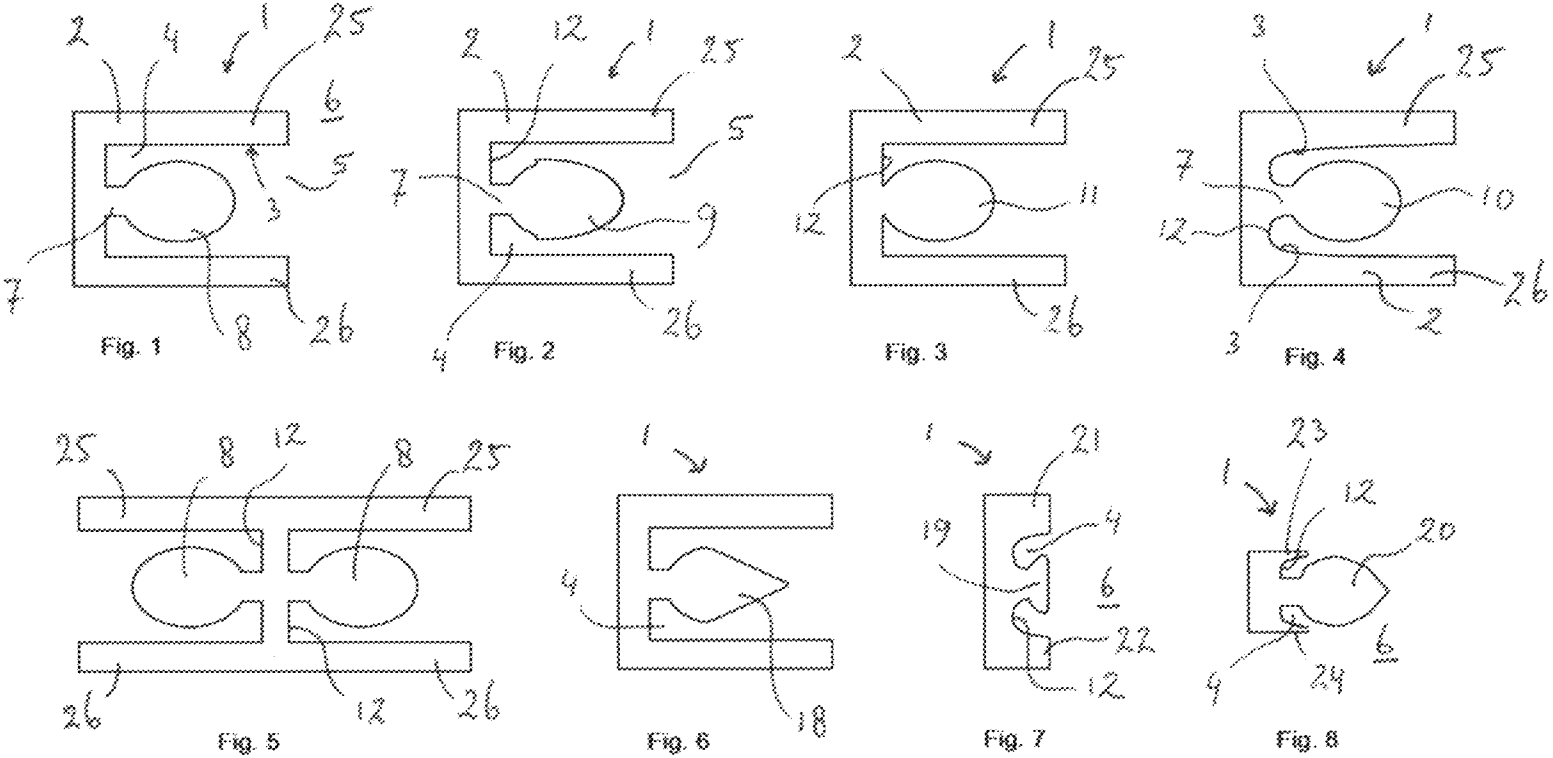
FIG. 5 shows a variant of the profile 1 in which two form elements 8 are provided, analogous to the variant according to FIG. 1.
FIG. 6 shows a variant of the profile 1, analogous to the variant according to FIG. 1, wherein the form element 18 tapers to a point.

FIG. 7 and FIG. 8 show a variant in which the dimension of the profile 1, measured from the access opening to the rear wall, is significantly shorter than in the other embodiments as shown in FIGS. 1 to 6. The walls 21, 22 and 23, 24 respectively are shorter than the walls 25, 26 of the other profiles. As a result, in the variant according to FIG. 8 shows the form element 20 partly outside the space defined by the side walls 23, 24. In the variant according to FIG. 7, the mold element 19 lies entirely within the walls defined by the side walls 21, 22, but the surface near the end of the side walls 21, 22 is flattened so that a substantially continuous surface with only two access openings to the space 4 is formed. To suitably place a panel in the internal space of the profiles according to FIG. 7 and FIG. 8, a mold will preferably have to be placed on either side of the access openings to the internal spaces 4 in order to correctly insert the plate-shaped elements into the internal spaces 4.

Figure 9:
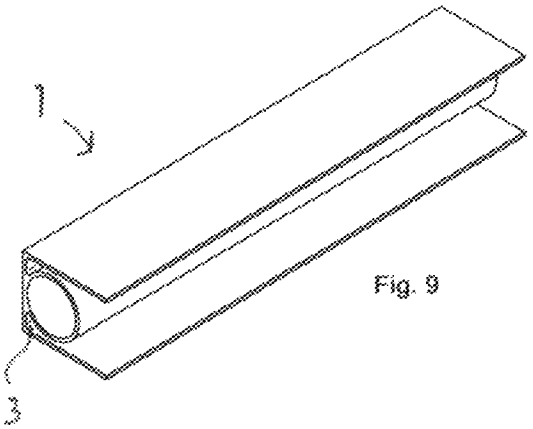

In FIG. 9 is a perspective view of the profile 1 according to FIG. 4, wherein the curved shape of the inner wall 3 is visible.

Figure 10:
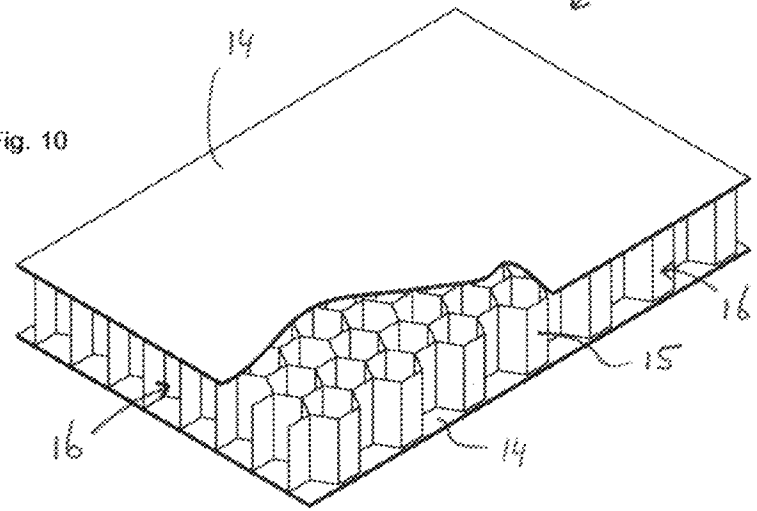

FIG. 10 shows a panel 13 for use in the building element according to the invention, wherein two plate-shaped elements 14 are separated by a deformable core material 15, here with a honeycomb-shaped structure 16. The plate-shaped elements 14 are made of a thermoplastic material and contain a fiber reinforcement. When the profile 1 is heated to a temperature at which the thermoplastic material becomes deformable, the plate-shaped elements 14 will deform when the panel 13 is inserted into the access opening 5 of the profile 1 and through contact with the heated profile 1, causing the thermoplastic material to be deformed during further introduction of the panel 13 in the interior space 4 of the profile 1 and to take the form of the interior space 4 and finally to fill it completely. The fiber reinforcement or fiber filling in the thermoplastic will co-deform in the internal space 4, so that upon cooling to a temperature at which the thermoplastic stiffens, an inseparable coupling between panel 13 and profile 1 is obtained at that temperature.

Figure 11:
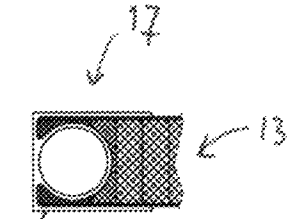

FIG. 11 finally shows a side view in section of a coupled profile 1 and panel 13 through which the building element 17 according to the invention is obtained.

The invention is not limited to the embodiments described above and shown in the figures. The invention is limited only by the appended claims.

The invention also extends to any combination of measures described above independently of each other.

The invention claimed is:

1. A building element, comprising a profile and a panel, wherein the profile and the panel are mutually coupled by means of a deformation of the panel inside the profile and wherein the profile comprises a housing with an inner wall and an internal space defined within the inner wall and at least one access opening in the inner wall providing access to the inner space, wherein in the inner space at least a part of a form element is arranged, which form element is coupled to the inner wall on a side remote from the access opening, and wherein a thickness of the form element near the coupling to the inner wall is smaller than at a position between the coupling to the inner wall and the access opening.

2. The building element according to claim 1, wherein the panel, in undeformed condition, comprises two main surfaces situated opposite each other, wherein the main surfaces each comprise a plate-shaped element of a material deformable when heated, and wherein between the two plate-shaped elements there is a deformable core material.

3. The building element according to claim 2, wherein the plate-shaped elements comprise a thermoplastic material.

4. The building element according to claim 1, wherein a width of an access opening of the profile is substantially equal to a distance between the two main surfaces of the panel in undeformed condition.

5. The building element according to claim 2, wherein the core material comprises a non-solid material.

6. The building element according to claim 1, wherein the form element comprises a shoulder surface directed away from the access opening.

7. The building element according to claim 1, wherein the profile in the internal space comprises an inner wall which extends arcuately from the access opening to the coupling of the core material with the outer wall.

8. The building element according to claim 1, wherein the profile comprises at least one material selected from a group consisting of a metal, a thermosetting material and a material with a resistance to deformation up to at least 170° C.

9. The building element according to claim 8, wherein the material with a resistance to deformation has a resistance to deformation up to at least 200° C.

10. The building element according to claim 8, wherein the material with a resistance to deformation has a resistance to deformation up to at least 250° C.

11. The building element according to claim 8, wherein the material with a resistance to deformation has a resistance to deformation up to at least 450° C.

12. A combination for manufacturing a building element according to claim 1, comprising a profile and a panel.

13. A method for manufacturing a building element according to claim 1, comprising the steps of joining the profile and the panel by inserting the panel into the access opening while deforming at least part of the panel inside the profile.

14. A method according to claim 13, comprising the step of deforming the two plate-shaped elements around a form element.

15. The method for manufacturing a building element according to claim 13, comprising the step of deforming the deformable core material.

16. A method according to claim 13, comprising the step of heating at least a part of the profile to a temperature at which at least a part of the panel is in a plastically deformable state and wherein the profile is in is in a non-plastically deformable state.

17. A method according to claim 16, wherein the temperature is between 150° C. and 650° C.

18. The profile for use in the building element according to claim 1, comprising a housing with an inner wall and an interior space and an access opening providing access to the interior space, wherein a form element is arranged in the interior space, which form element is coupled to the inner wall on a side remote from the access opening, and wherein a thickness of the form element near the coupling with the inner wall is smaller than at a position between the coupling with the inner wall and the access opening.

19. The profile according to claim 18, wherein the profile comprises a central material part with an internal space on different sides, each of said internal spaces with a form element and an access opening.

* * * * *